US009265677B2

(12) United States Patent
Manouchehri et al.

(10) Patent No.: US 9,265,677 B2
(45) Date of Patent: Feb. 23, 2016

(54) HOSPITAL CHAIR BEDS WITH STOWABLE STAND-ASSIST SUPPORTS

(75) Inventors: Nikou Manouchehri, Charleston, SC (US); Sohrab Soltani, Charleston, SC (US)

(73) Assignee: Piedmont 361, LLC, Dobson, NC (US)

( * ) Notice: Subject to any disclaimer, the term of this patent is extended or adjusted under 35 U.S.C. 154(b) by 913 days.

(21) Appl. No.: 13/516,271

(22) PCT Filed: Dec. 3, 2010

(86) PCT No.: PCT/US2010/058833

§ 371 (c)(1), (2), (4) Date: Sep. 28, 2012

(87) PCT Pub. No.: WO2011/087616

PCT Pub. Date: Jul. 21, 2011

(65) Prior Publication Data

US 2013/0007960 A1 Jan. 10, 2013

Related U.S. Application Data

(60) Provisional application No. 61/289,523, filed on Dec. 23, 2009, provisional application No. 61/352,472, filed on Jun. 8, 2010.

(51) Int. Cl.

*A61G 7/015* (2006.01)
*A61G 7/16* (2006.01)
(Continued)

(52) U.S. Cl.

CPC *A61G 7/16* (2013.01); *A61G 7/053* (2013.01); *A61G 7/0507* (2013.01); *A61G 7/1076* (2013.01); *A61G 2007/0514* (2013.01); *A61G 2200/32* (2013.01); *A61G 2200/34* (2013.01); *A61G 2200/36* (2013.01)

(58) Field of Classification Search

CPC ..... A61G 7/053; A61G 7/0533; A61G 7/16; A61G 7/1076; A47C 20/023; A47C 19/22
USPC ..... 5/507.1, 624, 635, 662
See application file for complete search history.

(56) References Cited

U.S. PATENT DOCUMENTS 1,778,698 A 10/1930 Walter
2,556,591 A 6/1951 Loxley
(Continued)

FOREIGN PATENT DOCUMENTS

EP 0780075 * 6/1997
EP 0801915 10/1997
(Continued)

OTHER PUBLICATIONS

International Search Report for corresponding PCT application No. PCT/US2010/058833, Date of mailing Aug. 22, 2011.

*Primary Examiner* — Michael Trettel
(74) *Attorney, Agent, or Firm* — Myers Bigel & Sibley, P.A.

(57) ABSTRACT

Embodiments of the invention are directed to hospital beds that are convertible to side egress chair beds and include a pair of spaced stand-assist supports pivotally attached to the base frame so that when the patient support surface is in the side-egress chair configuration, the stand-assist supports are configured to reside upwardly above and on opposing sides of the seat panel with a respective upper portion thereof providing a handle for a patient.

29 Claims, 13 Drawing Sheets

(51) Int. Cl.

| | |
|---|---|
| ***A61G 7/05*** | (2006.01) |
| ***A61G 7/053*** | (2006.01) |
| *A61G 7/10* | (2006.01) |

(56) References Cited

U.S. PATENT DOCUMENTS

| | | | | |
|---|---|---|---|---|
| 2,585,660 | A | 2/1952 | Kjos et al. | |
| 2,722,017 | A | 11/1955 | Burst | |
| 2,766,463 | A | 10/1956 | Bendersky | |
| 3,053,568 | A | 2/1960 | Miller | |
| 3,063,066 | A | 11/1962 | Peck et al. | |
| 3,112,500 | A * | 12/1963 | MacDonald | 5/618 |
| D199,957 | S | 1/1965 | Bertoldo | |
| 3,239,853 | A * | 3/1966 | MacDonald | 5/616 |
| 3,261,639 | A | 7/1966 | Phillips | |
| 3,286,283 | A | 11/1966 | Bertoldo | |
| 3,585,659 | A | 6/1971 | Burst et al. | |
| 3,821,821 | A | 7/1974 | Burst et al. | |
| 3,930,273 | A | 1/1976 | Stern | |
| 4,186,456 | A | 2/1980 | Huempfner | |
| 4,376,317 | A | 3/1983 | Johnston | |
| 4,409,695 | A | 10/1983 | Johnston et al. | |
| 4,439,880 | A | 4/1984 | Koncelik et al. | |
| 4,559,656 | A | 12/1985 | Foster | |
| 4,771,492 | A | 9/1988 | Paine et al. | |
| 4,787,104 | A | 11/1988 | Grantham | |
| 4,932,090 | A | 6/1990 | Johansson | |
| 5,060,327 | A | 10/1991 | Celestina | |
| 5,195,200 | A | 3/1993 | Leoutsakos | |
| D336,578 | S | 6/1993 | Celestina | |
| 5,257,426 | A | 11/1993 | Leoutsakos | |
| 5,337,430 | A | 8/1994 | Schlein | |
| 5,384,927 | A | 1/1995 | Mardero et al. | |
| 5,394,580 | A | 3/1995 | Foster et al. | |
| 5,398,357 | A | 3/1995 | Foster | |
| 5,418,988 | A | 5/1995 | Iura | |
| 5,425,151 | A | 6/1995 | Iura | |
| 5,444,883 | A | 8/1995 | Iura | |
| 5,479,666 | A | 1/1996 | Foster et al. | |
| 5,497,518 | A * | 3/1996 | Iura | 5/618 |
| 5,507,050 | A | 4/1996 | Welner | |
| 5,513,406 | A | 5/1996 | Foster et al. | |
| 5,678,267 | A | 10/1997 | Kinder | |
| 5,680,661 | A | 10/1997 | Foster et al. | |
| 5,715,548 | A | 2/1998 | Weismiller et al. | |
| 5,732,423 | A | 3/1998 | Weismiller et al. | |
| 5,787,530 | A | 8/1998 | Brix | |
| 5,878,452 | A | 3/1999 | Brooke et al. | |
| 6,058,531 | A | 5/2000 | Carroll | |
| D427,465 | S | 7/2000 | Thom et al. | |
| 6,154,899 | A | 12/2000 | Brooke et al. | |
| 6,163,903 | A | 12/2000 | Weismiller et al. | |
| 6,182,310 | B1 | 2/2001 | Weismiller et al. | |
| 6,185,767 | B1 | 2/2001 | Brooke et al. | |
| 6,185,769 | B1 | 2/2001 | Larisey et al. | |
| 6,240,583 | B1 | 6/2001 | Brooke et al. | |
| D445,614 | S | 7/2001 | Sommerfeld et al. | |
| 6,363,552 | B1 | 4/2002 | Hornbach et al. | |
| 6,367,104 | B1 | 4/2002 | Falbo, Sr. et al. | |
| 6,374,436 | B1 | 4/2002 | Foster et al. | |
| 6,397,416 | B2 | 6/2002 | Brooke et al. | |
| 6,487,735 | B1 | 12/2002 | Jacques, II et al. | |
| D475,559 | S | 6/2003 | Roussy | |
| 6,611,979 | B2 | 9/2003 | Welling et al. | |
| 6,629,325 | B2 | 10/2003 | Heavrin | |
| 6,640,360 | B2 | 11/2003 | Hornbach et al. | |
| 6,658,680 | B2 | 12/2003 | Osborne et al. | |
| 6,684,420 | B2 | 2/2004 | Koenig et al. | |
| 6,691,346 | B2 | 2/2004 | Osborne et al. | |
| 6,691,348 | B2 | 2/2004 | Plummer et al. | |
| 6,694,548 | B2 | 2/2004 | Foster et al. | |
| 6,725,474 | B2 | 4/2004 | Vogel et al. | |
| 6,728,985 | B2 | 5/2004 | Brooke et al. | |
| 6,807,695 | B1 * | 10/2004 | Barr | 5/602 |
| 6,829,793 | B2 | 12/2004 | Brooke et al. | |
| 6,851,142 | B2 | 2/2005 | Stryker et al. | |
| 6,874,179 | B2 | 4/2005 | Hensley et al. | |
| 6,880,189 | B2 | 4/2005 | Welling et al. | |
| 6,886,196 | B2 | 5/2005 | Nygren et al. | |
| 6,893,386 | B2 | 5/2005 | Charoenchit | |
| 6,912,746 | B2 | 7/2005 | Grove | |
| 6,934,984 | B2 | 8/2005 | Marsden et al. | |
| 6,961,972 | B2 | 11/2005 | Pendell | |
| 6,978,500 | B2 | 12/2005 | Osborne et al. | |
| 7,017,208 | B2 | 3/2006 | Weismiller et al. | |
| 7,024,708 | B2 | 4/2006 | Tomas et al. | |
| 7,028,354 | B2 | 4/2006 | Nygren et al. | |
| 7,032,265 | B2 | 4/2006 | Miller | |
| D520,783 | S | 5/2006 | Freeborn et al. | |
| 7,039,971 | B2 | 5/2006 | Sebastien | |
| 7,073,220 | B2 | 7/2006 | Simmonds et al. | |
| 7,150,058 | B2 | 12/2006 | Rabska et al. | |
| 7,171,709 | B2 | 2/2007 | Weismiller | |
| 7,197,779 | B2 | 4/2007 | Shalikar | |
| 7,234,182 | B2 | 6/2007 | Miller et al. | |
| 7,237,284 | B2 | 7/2007 | Hensley et al. | |
| 7,350,248 | B2 | 4/2008 | Hensley et al. | |
| 7,426,760 | B2 | 9/2008 | Vrzalik | |
| 7,458,119 | B2 | 12/2008 | Hornbach et al. | |
| 7,467,427 | B1 | 12/2008 | Wu et al. | |
| 7,472,445 | B2 | 1/2009 | Miller | |
| 7,513,000 | B2 | 4/2009 | DeBraal et al. | |
| 7,676,862 | B2 | 3/2010 | Poulos et al. | |
| 7,802,331 | B2 * | 9/2010 | Brown et al. | 5/610 |
| 8,375,489 | B2 | 2/2013 | Manouchehri | |
| 8,495,774 | B2 * | 7/2013 | Soltani | 5/618 |
| 2003/0086752 | A1 | 5/2003 | LeMole | |
| 2005/0102754 | A1 | 5/2005 | Barthelt | |
| 2005/0120485 | A1 * | 6/2005 | Sebastien | 5/662 |
| 2006/0059621 | A1 | 3/2006 | Poulos et al. | |
| 2006/0085914 | A1 | 4/2006 | Peterson et al. | |
| 2006/0230540 | A1 | 10/2006 | Whelan | |
| 2007/0017029 | A1 | 1/2007 | Wurdeman | |
| 2009/0007333 | A1 | 1/2009 | Guguin et al. | |
| 2009/0126114 | A1 * | 5/2009 | Kral et al. | 5/611 |
| 2010/0064439 | A1 | 3/2010 | Soltani | |
| 2013/0125310 | A1 | 5/2013 | Manouchehri | |

FOREIGN PATENT DOCUMENTS

| | | |
|---|---|---|
| EP | 2074910 | 7/2009 |
| JP | 05015556 | 1/1993 |
| WO | WO 2011087616 A2 * | 7/2011 |
| WO | WO 2012031159 A2 * | 3/2012 |

* cited by examiner

HOSPITAL CHAIR BEDS WITH STOWABLE STAND-ASSIST SUPPORTS

RELATED APPLICATIONS

This patent application is a 35 USC 371 national phase application of PCT/US2010/058833, filed Dec. 3, 2010, which claims the benefit of priority of and priority to U.S. Provisional Patent Application Ser. No. 61/289,523, filed Dec. 23, 2009 and U.S. Provisional Patent Application Ser. No. 61/352,472, filed Jun. 8, 2010, the contents of which are hereby incorporated by reference as if recited in full herein.

FIELD OF THE INVENTION

The present invention relates generally to the field of hospital beds and, more specifically, to hospital beds that are convertible into a chair configuration.

BACKGROUND

Conventional hospital beds are configured to provide a sufficiently comfortable support surface for patients in a supine position. In many cases, it is desirable for patients to elevate from a supine position to a sitting position in order to increase the activity of the circulatory and cardiovascular systems and/or in the course of medical treatment. In addition, patients may be interested in sitting up in bed to be more comfortable, for example, in order to read or meet with visitors. However, it may be difficult for some patients to get out of a hospital bed. As such, hospital beds that can be converted into chair-like configurations have been developed. In addition, hospital beds that can assist patients in moving from a supine position to a sitting position for the purpose of achieving a standing or walking position from a side egress orientation have also been developed.

SUMMARY OF EMBODIMENTS OF THE PRESENT INVENTION

Embodiments of the invention are directed to hospital beds with on-board, stowable stand-assist supports.

Embodiments of the invention are directed to hospital beds. The beds include: (a) a base frame comprising laterally spaced apart first and second long sides and longitudinally spaced apart top and bottom end portions; (b) a patient support surface, wherein the patient support surface comprises a back panel, a seat panel, and a leg panel configured to articulate relative to each other, and wherein the patient support surface is configured to translate from a bed configuration to a chair configuration; and (c) first and second spaced stand-assist supports, one residing on each side of the back panel, wherein when the back panel is upwardly oriented and the patient support surface is in the chair configuration, the stand-assist supports are configured to reside above and on opposing sides of the seat panel and extend outwardly from the back panel toward the leg panel in a substantially horizontal orientation.

Additional embodiments of the invention are directed to hospital beds that include: (a) a base frame comprising laterally spaced apart first and second long sides and longitudinally spaced apart top and bottom end portions; (b) a lifting mechanism secured to the base frame; (c) a rotating frame mounted on the lifting mechanism, wherein the rotating frame is configured to rotate about a vertical axis relative to the base frame; (d) a patient support surface pivotally secured to the rotating frame, wherein the patient support surface comprises a back panel, a seat panel, and a leg panel configured to articulate relative to each other, and wherein the patient support surface is configured to translate from a bed configuration to a side-egress chair configuration; and (e) first and second spaced stand-assist supports, one residing on each side of the back panel to be able to rotate with the back panel to the side-egress chair configuration, wherein when the patient support surface is in the side-egress chair configuration, the stand-assist supports are configured to reside above and on opposing sides of the seat panel and extend outwardly from the back panel toward the leg panel in a substantially horizontal orientation.

Embodiments of the present invention are directed to hospital beds that have a patient support surface including a back panel, a seat panel and a leg panel. The bed is configured to rotate to a side egress chair configuration. The bed is characterized in that the hospital bed includes a pair of stand-assist supports, one residing proximate each long side of the back panel that are pivotably attached to a respective portion of the back panel and rotate with the back panel to the side-egress chair configuration. When the bed is in the side-egress chair configuration, the stand-assist supports are configured to pivot outward from the back panel to reside above and on opposing sides of the seat panel.

Yet other embodiments are directed to methods of operating a hospital bed. The methods include pivoting a pair of stand-assist supports from a respective stowed position proximate opposing sides of an outer perimeter of a back panel to an outwardly extending configuration above a seat panel of the patient support surface so that one support resides on one side of a seat panel and the other resides on the other side of the seat panel.

The method may include converting the bed into a chair bed either an end egress or side egress chair bed.

The methods may include (a) rotating an articulating patient support surface to a side egress position; and pivoting the stowed supports before, during or after the rotating step.

Embodiments of the invention are directed to hospital beds that include: (a) a base frame comprising laterally spaced apart long sides and longitudinally spaced apart end portions; (b) a lifting mechanism secured to the base frame between the end portions; (c) a rotating frame mounted on the lifting mechanism; (d) a patient support surface pivotally secured to the rotating frame, the patient support surface includes a back panel, a seat panel, and leg section configured to articulate relative to each other; and (e) a pair of longitudinally spaced stand-assist supports pivotally attached to one of the long sides of the base frame. The frame is configured to rotate horizontally (e.g., about a vertical axis) relative to the base. The patient support surface is configured to translate from a bed configuration to a side-egress chair configuration. When the patient support surface is in the side-egress chair configuration, the stand-assist supports are configured to reside above and on opposing sides of the seat panel to provide a respective support (e.g., handle) for a patient.

In some embodiments, the hospital bed can also include a second pair of longitudinally spaced stand-assist supports pivotally attached to the other long side of the base frame. When the patient support surface is in the side-egress chair configuration, one pair of the stand-assist supports are configured to reside above and on opposing sides of the seat panel.

In particular embodiments, the stand-assist supports are only deployable when the bed is in the side-egress chair position and/or the stand-assist supports block rotation of the patient support surface while extended.

The stand-assist supports may include an angular upper portion that extend to provide respective handles with gripping surfaces for a patient. The handles may optionally be shaped the same and each can have an angle of between about 100-130 degrees measured from a line drawn through a tip of the handle to an intersecting line drawn perpendicular to a centerline of the second portion.

In some embodiments, at least one of the stand-assist supports may be releasably mounted to the base frame such that when released, the support defines a cane that can be used by a patient.

The stand-assist supports may be mounted to the base frame to allow the supports to be longitudinally moved about the base frame to allow for lateral adjustment with respect to the seat section in the side-egress chair position.

The stand-assist supports may be mounted to the base frame to be able to be adjusted in height to lock in different height positions.

In some embodiments, the bed can include a first pair of side rails and a second pair of side rails longitudinally spaced apart from the first pair of side rails. Each side rail can be movably mounted to the bed with the first pair residing on opposing sides of the back panel and the second pair residing on opposing sides of the leg section, with the second pair configured to reside substantially vertically when the bed is in the side-egress chair configuration. When the bed is in the side-egress chair configuration, the stand-assist supports have handles that extend toward each other across the seat panel above the second pair of side rails and closer to a center of the seat section than the second pair of side rails.

In some particular embodiments, the leg section includes first, second, and third panels pivotally connected together in series. The leg section first panel can be pivotally connected to the seat panel and at least some of the plurality of leg section panels can be configured to overlap each other when the patient support surface is in the side egress chair configuration so that at least two of the leg section panels are in a substantially horizontal orientation.

In some embodiments, the hospital bed is configured to also be able to translate to a stand-assist configuration whereby the seat panel is tilted downward at (typically at an angle up to and including about 30 degrees) while the back panel is substantially upright (or slightly inclined between about 10-20 degrees in a forward direction).

Still other embodiments are directed to methods of operating a hospital bed. The methods include: (a) articulating back, seat and leg sections of a patient support surface relative to each other from a substantially co-planar configuration to a chair configuration; (b) rotating the back, seat and leg sections 90 degrees to a side egress position; then (c) after the rotating step, extending a pair of stand-assist supports from a stowed position to an upwardly extending configuration so that one support resides on one side of the seat section and the other resides on the other side of the seat section; (d) inhibiting (electronically and/or physically) rotation of the back, seat and leg sections while the stand-assist supports are extended.

The methods may also include (e) tilting the seat section downward at an angle of up to about 30 degrees while the back section is substantially vertical to move the bed to a stand-assist side egress configuration while the stand-assist supports are extended.

Other embodiments are directed to hospital beds that include: (a) a base frame comprising laterally spaced apart first and second long sides and longitudinally spaced apart top and bottom end portions; (b) a lifting mechanism secured to the base frame; (c) a rotating frame mounted on the lifting mechanism configured to rotate horizontally relative to the base frame; (d) a patient support surface pivotally secured to the rotating frame, wherein the patient support surface comprises a back panel, a seat panel, and a leg section configured to articulate relative to each other, and wherein the patient support surface is configured to translate from a bed configuration to a side-egress chair configuration; and (e) a pair of spaced stand-assist supports attached to the back panel to be able to rotate with the back panel to the side-egress chair configuration.

When the patient support surface is in the side-egress chair configuration, the stand-assist supports are configured to reside above and on opposing sides of the seat panel and are substantially horizontal.

Some embodiments are directed to hospital beds characterized in that the hospital bed includes a pair of spaced stand-assist supports that attach to the back panel. The stand-assist supports are configured to reside above and on opposing sides of the seat panel and are substantially horizontal and oriented to extend along an outer long edge portion of the seat panel in a direction that extends from the back panel.

Yet other embodiments are directed to methods of operating a hospital bed. The methods include: (a) articulating back, seat and leg sections of a patient support surface relative to each other from a substantially co-planar configuration to a chair configuration; (b) rotating the back, seat and leg sections 90 degrees to a side egress position; then (c) after the rotating step, pivoting a pair of stand-assist supports from a respective stowed position against opposing sides of an outer perimeter of a back panel to an outwardly extending configuration so that one support resides on one side of the seat section and the other resides on the other side of the seat section, both a distance above the seat section.

It is noted that any one or more aspects or features described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

BRIEF DESCRIPTION OF THE DRAWINGS

The accompanying drawings, which form a part of the specification, illustrate embodiments of the present invention. The drawings and description together serve to fully explain the invention.

DETAILED DESCRIPTION

Figure 1A:
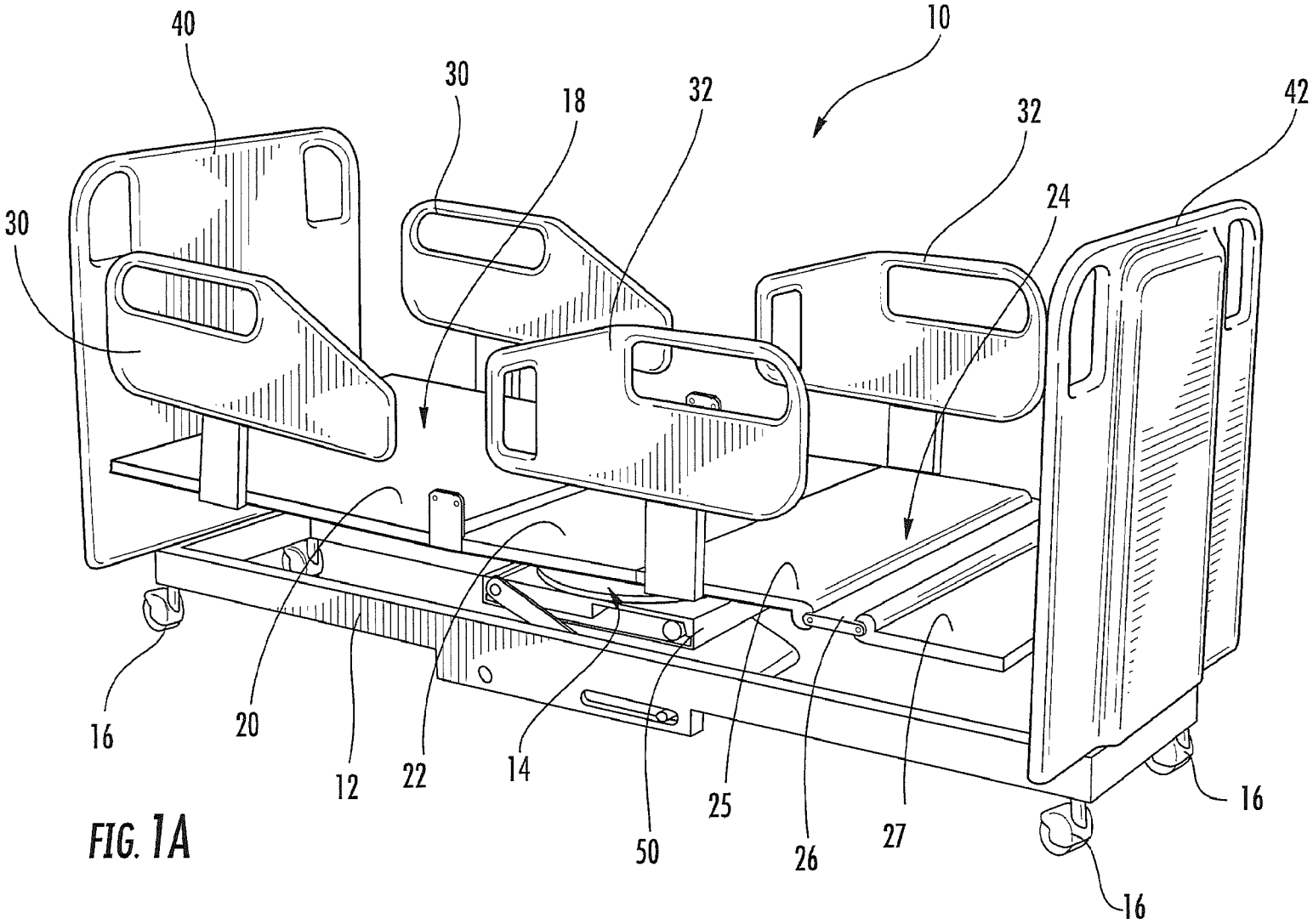
FIG. 1A is a side perspective view of a hospital chair bed in the bed configuration, according to some embodiments of the present invention.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the figures.

As used herein, the singular forms "a," "an," and "the" are intended to include the plural forms as well, unless expressly stated otherwise. It should be further understood that the terms "comprises" and/or "comprising" when used in this specification are taken to specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The term "hospital bed" is used broadly herein to refer to a bed for persons in whatever environment the bed is used and is not limited to use in a hospital per se (e.g., a hospital bed may be used in a private home, nursing home, rehab center, short term or long term care facility, outpatient treatment center and the like). It is noted that although certain features of the hospital beds are described with respect to a hospital bed that can be converted into a chair bed, it is contemplated that embodiments are not limited thereto and can be used with any type of hospital bed. Further, although primarily described for use with a side-egress chair bed, embodiments can be used with end-egress chair beds.

In the drawings, the thickness of lines, layers and regions may be exaggerated for clarity. It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". A device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a "first" element, component, region, layer or section discussed below could also be termed a "second" element, component, region, layer or section without departing from the teachings of the present invention.

The beds can be configured with lift mechanisms and patient supports that have structural ratings sufficient to provide lift functions for weight ranges of patients, e.g., between about 100-1200 lbs, typically between about 100-1200 lbs, such as between about 100-1000 lbs or between about 100-

500 lbs, and the like, but may also be configured to accommodate larger weight patients and smaller weight patients including bariatric patients.

Figure 1B:
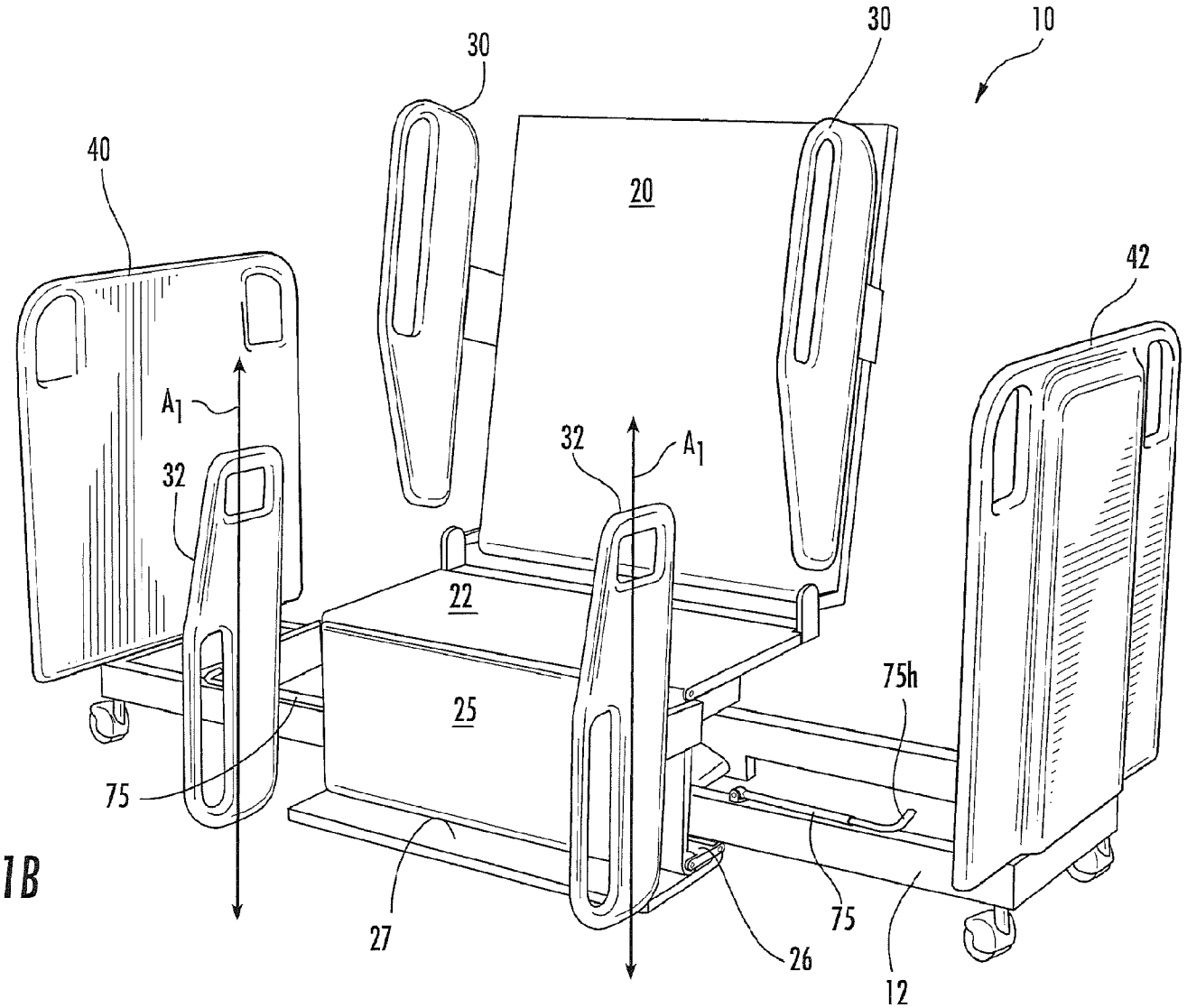
FIG. 1B is a side perspective view of the hospital bed shown in FIG. 1A with the bed in a side egress chair configuration with stowable stand assist supports according to embodiments of the present invention.
Figure 2:
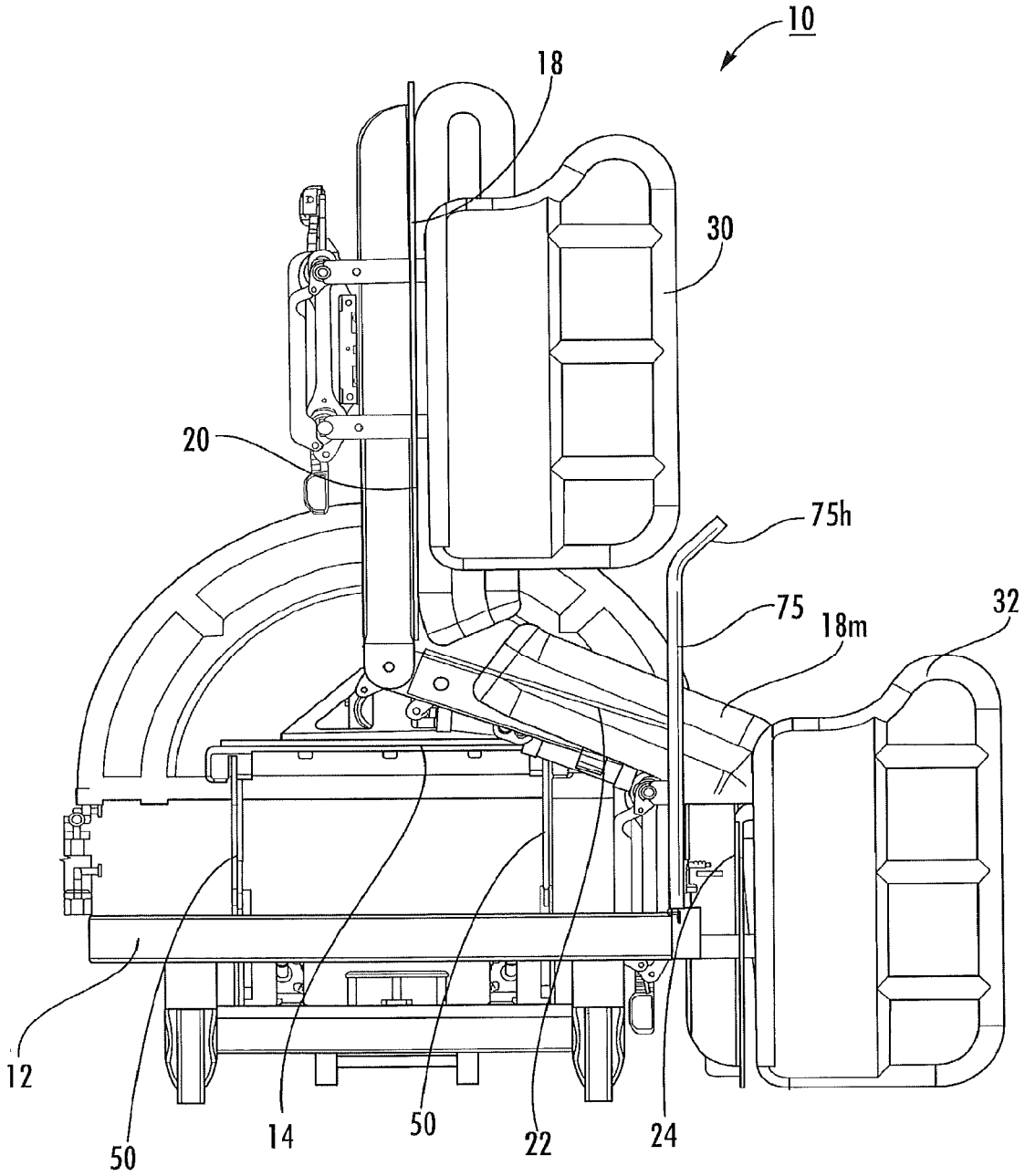
FIG. 2 is a side view of the chair bed shown in FIG. 1B in a stand assist side egress configuration with stowable stand assist supports deployed according to embodiments of the present invention.

Referring to FIGS. 1A, 1B and 2, a hospital bed 10, according to some embodiments of the present invention, is illustrated. The illustrated bed 10 has a base 12 and a rotating frame 14 mounted on the base 12. The frame 14 is configured to rotate relative to the base 12 to facilitate side egress from the bed 10 by a patient, as will be described below. Casters 16 can be mounted to the four corners of the base 12 and facilitate movement of the bed about the hospital or other environment. In some embodiments, casters 16 are locking casters that can be selectively locked to prevent movement of the bed 10.

The illustrated bed 10 has a patient support surface 18 configured to support a mattress 18*m* (FIG. 2) on which a patient is situated. The patient support surface 18 is supported by the rotating frame 14 and includes a back panel 20, a seat panel 22, and a leg panel or section 24. The back panel 20, seat panel 22 and leg section 24 can articulate with respect to each other and may be serially hinged together. The back panel 20 and seat panel 22 can be pivotally attached to each other by pins, hinges, or other suitable mechanisms well known in the art. The seat panel 22 and leg section 24 can also be pivotally attached to each other by pins, hinges, or other suitable mechanisms well known in the art.

The bed 10 also can have a first set of patient side rails 30 typically secured to the back panel 20 in spaced-apart relationship and a second set of patient side rails 32 typically secured to the seat panel 22 or leg section 24 in spaced-apart relationship, as illustrated. A head board 40 can be secured to the base 12 at the head end of the bed 10 and a foot board 42 can be secured to the base 12 at the foot end of the bed 10, as illustrated.

The patient support surface 18 can be secured to the rotating frame 14 via a transverse rod or pin connection (not illustrated) to facilitate tilting of the patient support surface 18 relative to the rotating frame 14. The rotating frame 14 is secured to the base 12 via a lift mechanism 50 (FIG. 1A, 2), such as a double scissors lift. The lift mechanism 50 is configured to raise and lower the patient support surface 18, via the rotating frame 14, relative to the base 12. The lift mechanism 50 can be driven by hydraulic cylinders, air cylinders, air bags, and/or other electrical or electromechanical devices, etc. The lift mechanism 50 can be configured to allow the patient support surface 18 to be raised above and lowered with respect to the base 12. See, e.g., co-pending U.S. patent application Ser. No. 11/398,098 for examples of rotational and lift components, which is incorporated herein by reference in its entirety.

Figure 3:
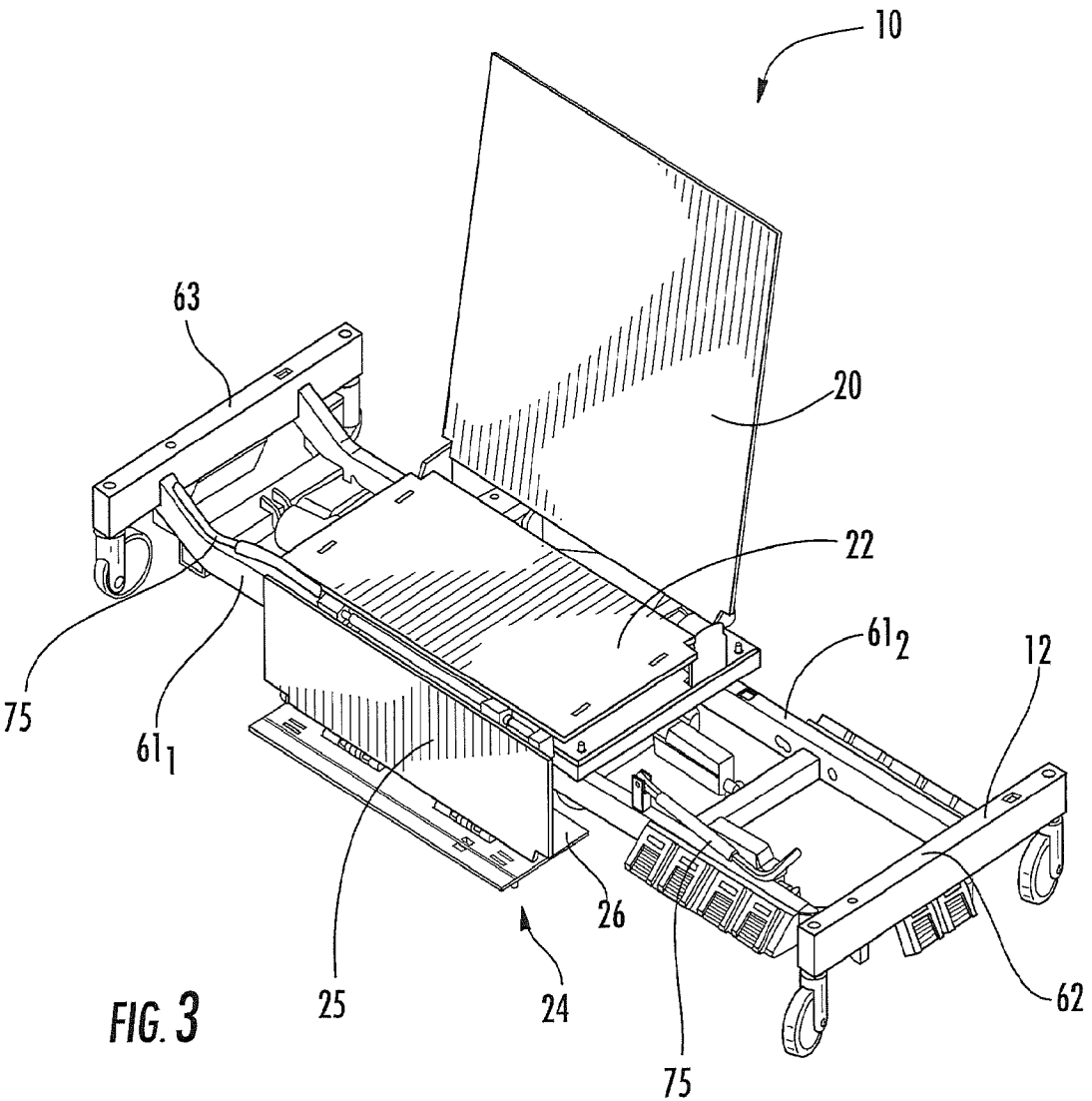
FIG. 3 is a side perspective view of a side egress bed with stowable stand assist supports in a stored configuration (and with patient support side rails removed) according to embodiments of the present invention.

As shown in FIGS. 1B and 2, the bed 10 can include at least one on-board, stowable stand-assist support 75 (shown in FIG. 1B as two, one on each side of the seat section 22) that is attached to the base frame 12. One end portion of the support 75 can be affixed to a long side of the frame $\mathbf{61}_1$ (FIG. 3). When the bed 10 is in a side egress orientation, as shown in FIG. 1B, the on-board, stowable stand-assist support(s) 75 can be manually or automatically deployed upward so that a patient sitting in the chair bed (after the bed is turned 90 degrees relative to the normal sleeping position/orientation) can contact the handle portions 75*h* on the top end portions thereof. Where automated deployment is used, the (unlock) or deployment or extension of the supports can be electronically controlled via sensors and monitoring circuits, signal processors, and/or computers and may use actuators, hydraulic or pneumatic cylinders, springs, linkages or other devices known to those of skill in the art.

The stand-assist supports 75 can be configured to inhibit rotation of the bed back to alignment with the long sides of the frame when the stand-assist supports 75 are deployed (e.g., extended). The supports 75 can be configured to have a low profile to mount to the side frame(s) 61 during non-use and allow the patient support surface 18 to articulate, lift and rotate without interference with the predetermined normal motions of the bed. The supports 75 can be used with the patient side rails 30, 32 as shown for example in FIGS. 1B and 2.

In some embodiments, the leg panel or section 24 can be configured to have a plurality of segments that translate relative to each other to be able to take on different orientations when in the chair versus bed positions. FIG. 3 illustrates that the leg section 24 has at least two adjacent panels 25, 26 that can move from being horizontal and in co-planar relationship in the bed position to being substantially orthogonal in the side egress chair position. As shown, the lower panel 26 can be substantially horizontal while the other panel 25 is substantially vertical. The lower panel 26 can extend toward the interior space of the bed/base frame 12 and a smaller portion of the lower panel 26 may reside forward of the upper panel 25.

In other embodiments, the back panel and seat panel may disengage from the foot or leg panel and not rotate into the side egress position. See, e.g., U.S. patent application Ser. No. 12/499,896, the contents of which are hereby incorporated by reference as if recited in full herein.

Figure 4A:
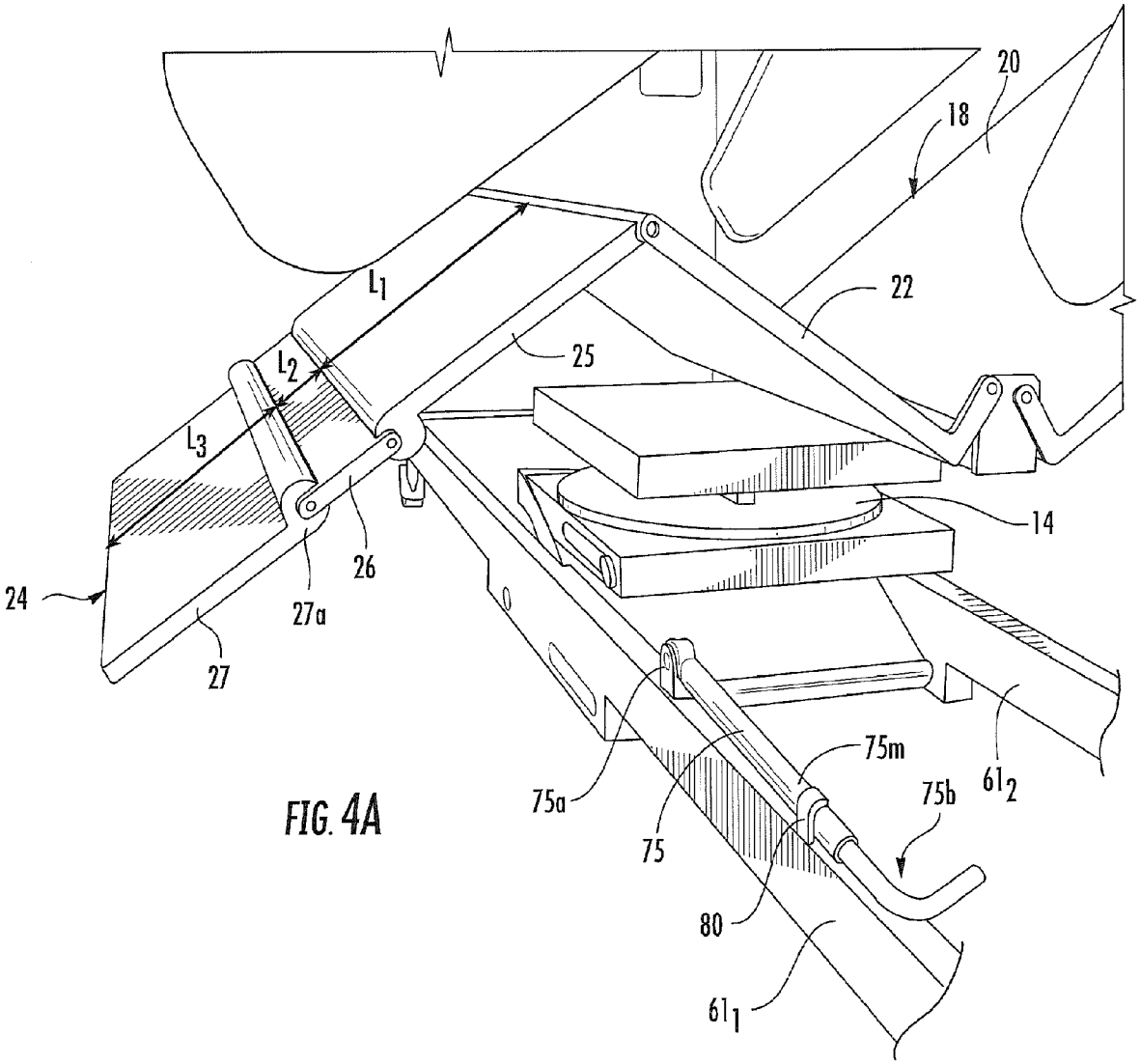
FIG. 4A is a partial side perspective view of the bed shown in FIG. 1B with a leg section with foldable and/or pivotable segments according to embodiments of the present invention.
Figure 4B:
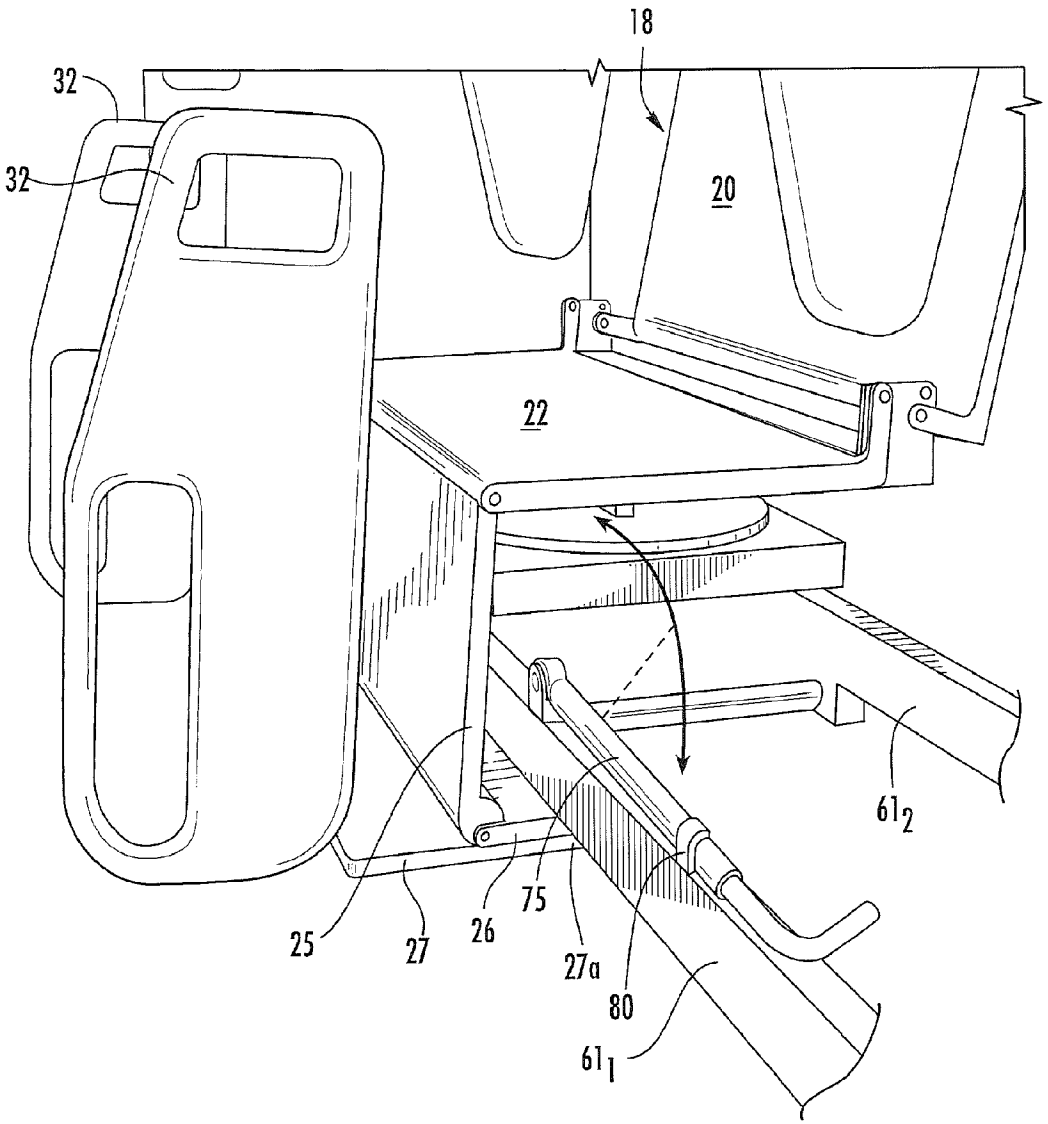
FIG. 4B is a partial side perspective view of the bed shown in FIG. 4A with the leg section folded in a chair configuration according to some embodiments of the present invention.

In some embodiments, as illustrated in FIGS. 1A, 1B, 3, 4A and 4B, the leg section 24 includes a first panel 25, a second panel 26, and a third panel 27 pivotally connected together in series. The leg section first panel 25 can be pivotally connected to the seat panel 22 of the articulating patient support surface 18. When the patient support surface 18 is in a horizontal configuration to support a patient in a supine position, the leg section first, second and third panels 25, 26, 27 can be in substantially co-planar relationship as illustrated in FIG. 1. The leg section panels 25, 26, 27 are configured to be able to fold together and/or overlap at least portions of each other when the patient support surface is in a chair configuration, as illustrated in FIG. 4B.

As illustrated in FIG. 4A, the leg section panels 25, 26, 27 have respective different lengths $L_1$, $L_2$, $L_3$. The length $L_1$ of panel 25 is greater than the lengths $L_2$ and $L_3$ of panels 26 and 27. $L_1$ may be between about twelve inches and about twenty four inches (12"-24"). The length $L_3$ of panel 27 is greater than the length $L_2$ of panel 26, but is less than the length $L_1$ of panel 25. $L_3$ may be between about ten inches and about twenty inches (10"-20"). The length $L_2$ of panel 26 is less than both $L_1$ of panel 25 and $L_3$ of panel 27. $L_2$ may be between about six inches and about twelve inches (6"-12"). Other patient support configurations and/or leg section configurations may be used.

In operation, the bed 10 typically has the back panel 20, seat panel 22, and leg section 24 in a horizontal configuration as shown in FIG. 1A, to support a patient in a supine position. To convert the bed 10 to a chair configuration, the back panel 20, seat panel 22 and leg section 24 articulate relative to each other as shown in FIG. 2, for example by an actuator (e.g., pneumatic or hydraulic cylinder or other suitable mechanism). Specifically, as shown in FIG. 1B, the back panel 20 and the seat panel 22 can pivot relative to each other until they are substantially orthogonal to each other. The articulated patient support surface 18 can be placed in a "zero-gravity" configuration or other desirable shape and rotated approximately ninety degrees (90°) to permit side egress from the bed 10, as illustrated in FIGS. 1B and 3. Once rotated approximately ninety degrees (90°) to permit side egress from the bed 10, the articulated patient support surface 18 can then be tilted as a unit, as illustrated in FIG. 1B, until the seat panel 22 is substantially horizontal. At this point, the back panel 20 may be substantially vertical. In some embodiments, the bed 10 can then be further moved to a stand-assist configuration with the seat 20 tilted down about 30 degrees and the back 20 being positioned substantially vertically.

In some particular embodiments, as or after the patient support surface 18 is rotated to the side egress position, the first, second, and third panels 25, 26, 27 of the leg section 24 pivot relative to each other. Tilting of the articulated patient support surface 18 can cause the first, second, and third panels 25, 26, 27 to pivot relative to each other such that the third panel 27 is substantially horizontal, the second panel 26 is in overlying, face-to-face contact with the third panel 27, and the first panel 25 is substantially vertical. This causes a rear portion 27*a* of the third panel 27 to extend under the base 12 of the bed, as illustrated in FIG. 4B. As such, the third panel 27 is substantially out of the way of the feet of a patient who wishes to egress from the bed 10 and/or allows for the bed to accommodate a greater range of patient sizes to exit the bed while contacting the floor (e.g., short and tall patients).

Thus, in some particular embodiments, the leg section first, second and third panels 25, 26, 27 pivot relative to each other such that, when the patient support surface is in the side egress chair configuration, the third panel is substantially horizontal, the second panel is in overlying, face-to-face contact with the third panel, and the first panel is substantially vertical. The leg section first second and third panels 25, 26, 27 pivot relative to each other such that, when the patient support surface is in a chair configuration, a portion of the third panel extends beneath the base. The leg section first, second, and third panels 25, 26, 27 each have respective different lengths. Typically, the leg section first panel has a length that is greater than a length of the second and third panels.

As shown in FIG. 1B, the side rails 32, can be secured to the leg section 24 and may optionally rotate with the leg section 24 so as to be oriented such that a longitudinal direction thereof $A_1$ is substantially vertical (FIG. 1B) when the bed is in a side egress position. In other embodiments, the side rails 32 can be removed prior to rotation or not used on the bed 10 at all.

In some embodiments, as shown in FIG. 2, the side rails 32 can remain on the bed but the stand assist supports 75 are configured to be used as support handles 75*h* to help a patient stand up from a sitting position on the support surface 18. The patient support surface 18 may then be raised and tilted forward, if necessary, to facilitate patient egress from the support surface 18 (e.g., a "stand-assist" orientation). In other embodiments, the stand-assist supports 75 can be used when the bed 10 is in the chair configuration shown in FIG. 1B, and/or to help patients rise or exit the bed in both side egress configurations (e.g., FIG. 1B and FIG. 2), where used.

Figure 5:
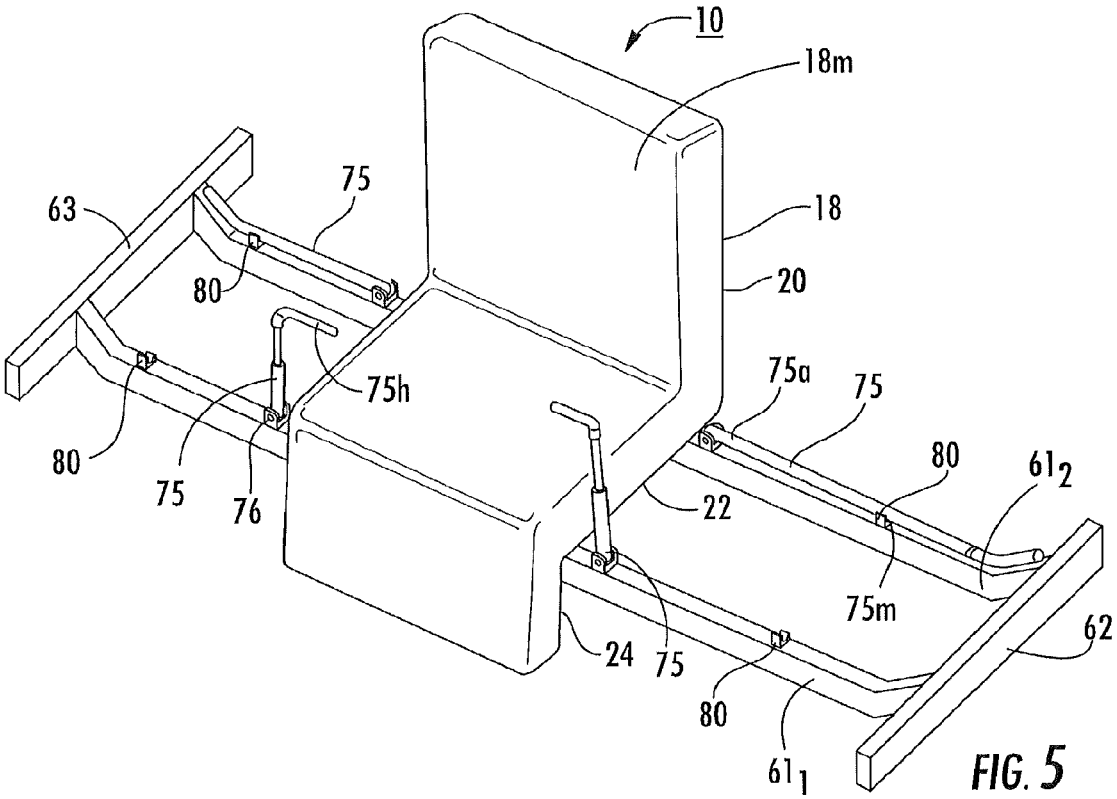
FIG. 5 is a top side-perspective view of a hospital chair bed with two sets of stowable stand assist supports in a deployed operative position according to embodiments of the present invention.
Figure 7:
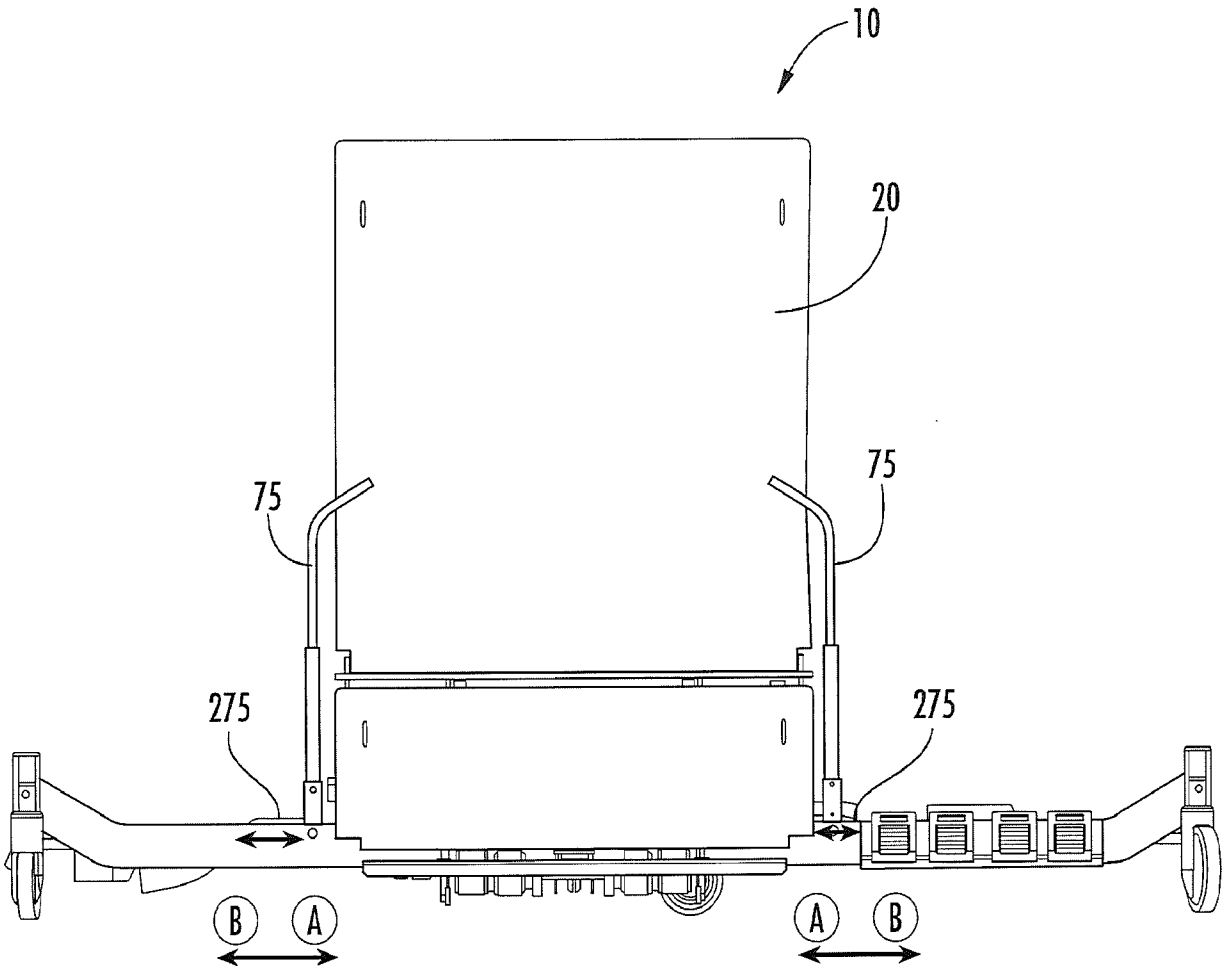
FIG. 7 is a front view of a side egress hospital chair bed with support members deployed and the bed in the side egress orientation according to some embodiments of the present invention.
Figure 8:
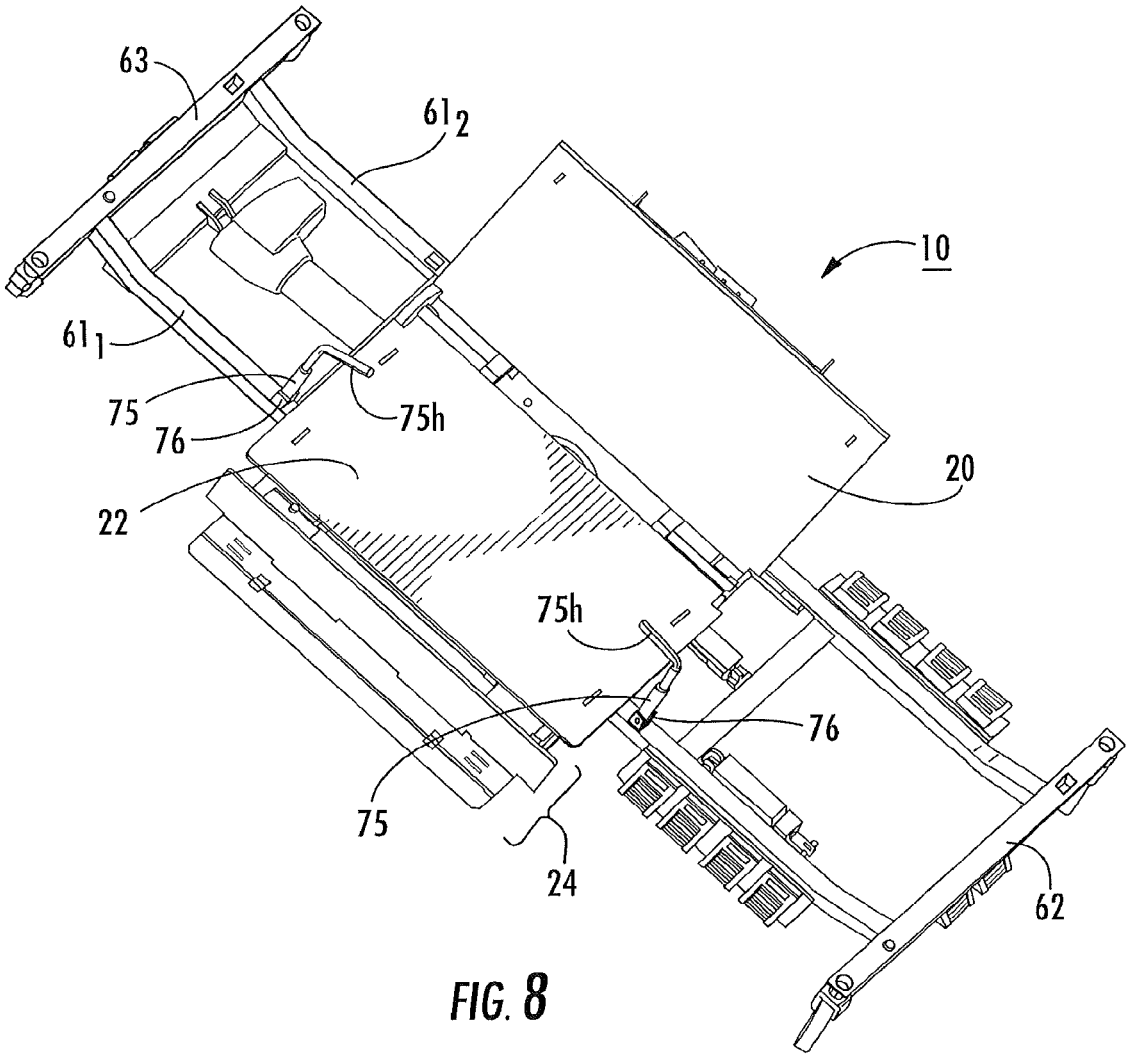
FIG. 8 is a top view of the bed shown in FIG. 6.

Referring now to FIGS. 3, 7 and 8, the bed 10 can be configured with at least one pair of stand-assist supports 75 that stow proximate to (typically against) one long side of the base frame 61. The supports 75 can be stowed to reside against an upper surface of the long side of the base frame 61, one on opposing sides of the seat section 22 (when in the side egress position). The handle 75*h* can be oriented to face into the interior space of the bed (when stowed). However, one or both of the supports 75 may alternatively optionally store against an upwardly extending (vertical) surface of the long side of the base frame 61 (not shown) under the patient support surface 18. The support 75 can be attached to the long side 61 of the base frame 12 via pivot 76 at one end portion 75*a* (the end portion away from the handle 75*h*) and may be held in the stow position using a retention member 80 at a medial 75*m* or opposing end portion 75*b* (FIG. 4A, 5). The support 75 can be configured with sufficient structural capacity/integrity so that the handle 75*h* is accessible by a user and the upper end 75*b* does not require any cross-support. The retention member 80 can be any suitable configuration to releasably hold the support 75 against the frame 12 as is well known to those of skill in the art. For example, the retention member 80 can comprise a resilient clip with an open front to frictionally engage and release the support 75 from the stowed position. Typically, the support 75 is securely held against (and may be directly against) the frame 61, but no affirmative lock is required.

Figure 10:
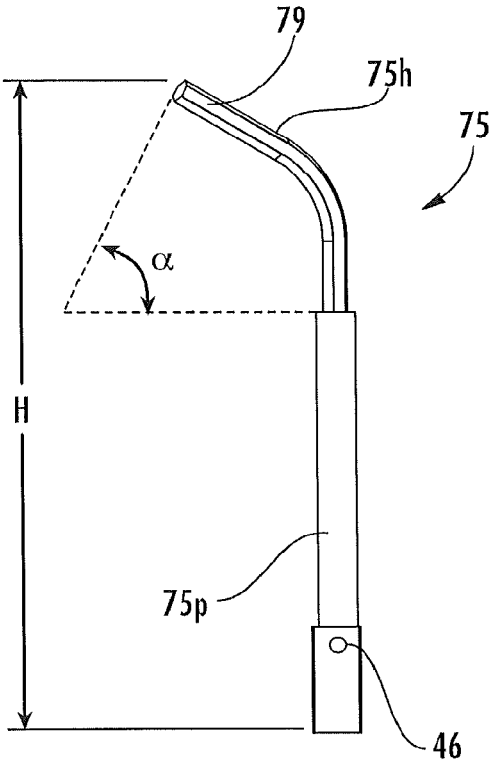
FIG. 10 is a side view of an exemplary stand assist support according to embodiments of the present invention.

The supports 75 can have a primary body 75*p* (FIG. 11) that is mounted to the frame 61 to allow a single plane of motion and to be able to affirmatively stop when rotated up and positioned to reside adjacent the seat panel 22 on the corresponding side of the bed 10 without allowing further rotation. That is, the primary body 75*p* of each support 75 can be mounted to the frame 61 to have a limited travel from about 0-90 degrees between the stowed and the active positions. The handle 75*h* can rotate independently of the primary body 75*p* and may be extendable relative thereto. The handle 75*h* can have an angular shape with an angle "a" of between about 100-130 degrees, typically about 120 degrees measured from a longitudinally extending segment centerline to a tip thereof (FIG. 10).

The support 75 and handle 75*h* can be configured to provide the structure necessary to reliably support the weight of typical patients. In some embodiments the support 75 can be configured to accommodate patients having a weight between about 100-500 lbs. The handle end 75*h* can include a textured and/or elastomeric gripping surface. Replaceable (textured) end grips can be used where desired (not shown).

FIG. 5 illustrates that the bed 10 can include two pairs of the supports 75, one on one long side $\mathbf{61}_1$ and one on the other $\mathbf{61}_2$. This allows a user to select one of the different pair of supports 75 to be used depending on which way the bed 10 is rotated for side egress (e.g., in either a left or right direction). In some embodiments, a user can extend both pairs of the supports 75 when the bed is in the side-egress chair configuration, but typically a single pair is used while the other pair remains stowed against or proximate the frame 61.

Figure 6:
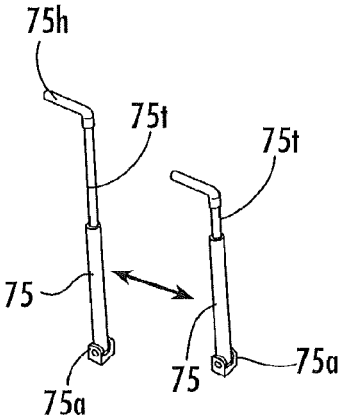
FIG. 6 is a side perspective view of the stand-assist supports of FIG. 5 in respective telescoping extended and retracted positions according to embodiments of the present invention.
Figure 12:
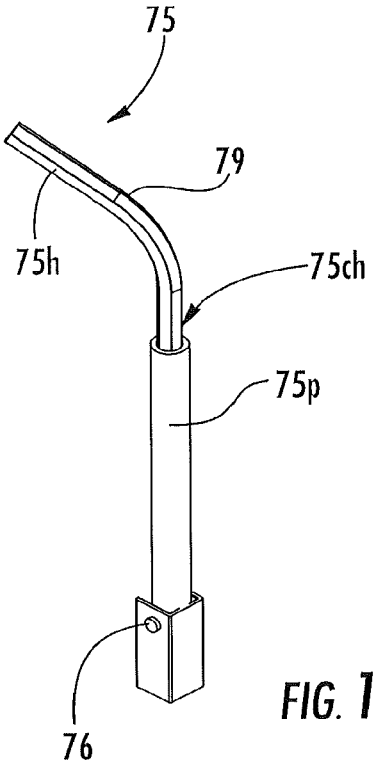
FIG. 12 is a side perspective view of the stand assist support shown in FIGS. 10 and 11.

As shown in FIG. 6, the supports 75 can be configured to be adjustable in at least a length dimension (e.g., upwardly) to allow for different size patients. Typically, the height "H" of the handle 75*h* can be adjustable between about 3-8 inches and may be configured to be able to selectively reside (lock into a desired position) between about 18 inches to about 23 inches above the base frame 61 (FIG. 10). As shown in FIG. 6, the length adjustment can be via a telescopic configuration with the handle rod 79 being able to be translated vertically to a desired length and self-lock based on the configuration and frictional engagement of the handle rod 79 and channel 75*ch* (FIG. 12). In other embodiments, a positive locking feature or component such as a spring pin, cotter pin, clevis pin or other locking member/configuration may be used. The support 75 can include an anti-rotation configuration or member to allow the handle rod 79 to stay in the proper orientation so that the handles 75*h* project toward each other across the seat section/panel 22 to define a comfortable patient stand-assist support that is easily accessible by different sized patients at the desired heights. The anti-rotation can be provided by a geometrically shaped channel and a corresponding shaped rod forming a portion of the handle, a D-shaped channel or a slot in the handle that mates with a pin mounted internal to the channel and the like.

As shown in FIG. 7, the supports 75 may also be mounted to the base frame to allow for lateral adjustment, e.g., the frame can include a lockable track/slot configuration 275 (shown as longitudinally adjustable on the frame for a lateral adjustment with respect to the seat between positions A and B). The frame track/slot configuration 275 may also or alternatively hold the supports 75 to allow for transverse adjustment (to reside closer the forward edge of the seat section or to reside closer toward the back section).

Figure 9:
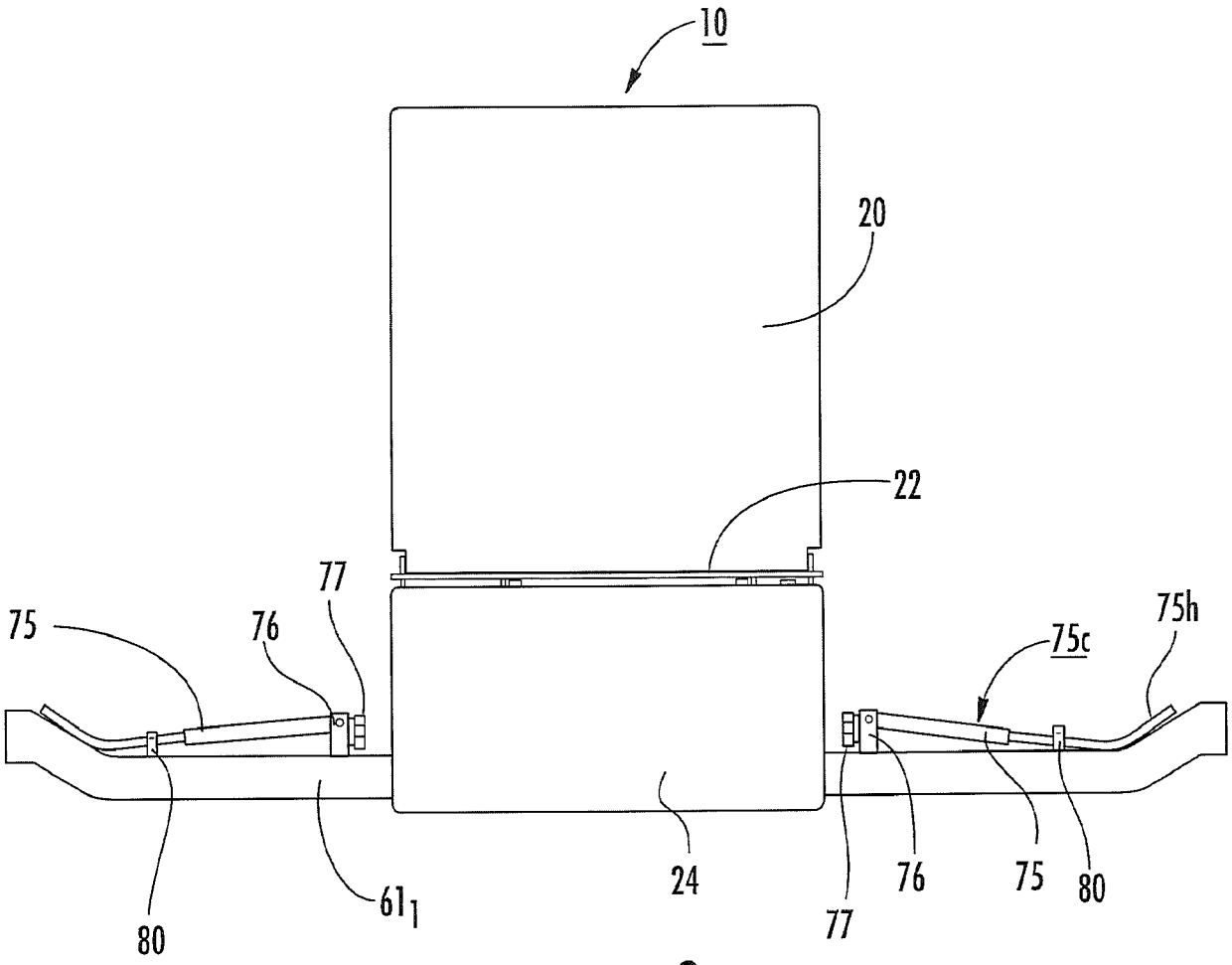
FIG. 9 is a side view of a chair bed in a side egress orientation with stowable stand-assist supports (stored, non-deployed) according to embodiments of the present invention.

Referring now to FIG. 9, one or both of the stand-assist supports 75 can be configured to define a cane 75*c* with the handle 75*h*. In some embodiments, only one of the stand assist supports 75 in each pair can be used as a cane 75*c* and the other stand-assist support has a different end configuration and is mounted to the frame in a different manner. The support member 75 defining the cane 75*c* can be released from the frame $\mathbf{61}_1$ when exiting or after exiting the bed 10 for use by the patient. The lower(ground) end of the cane 75*c* can include an anti-slip member 77 that can be added to the cane 75*c* prior to use by the patient or may reside on the support proximate the pivot attachment end portion 76 (the latter is shown attached in FIG. 9). The anti-slip member 77 can be an elastomeric cap or film that can be replaced as needed due to use. In other embodiments, the cane floor contacting end can be configured with grooves, embossments or other textures to provide an increased friction surface without requiring a separate member 77.

Figure 11:
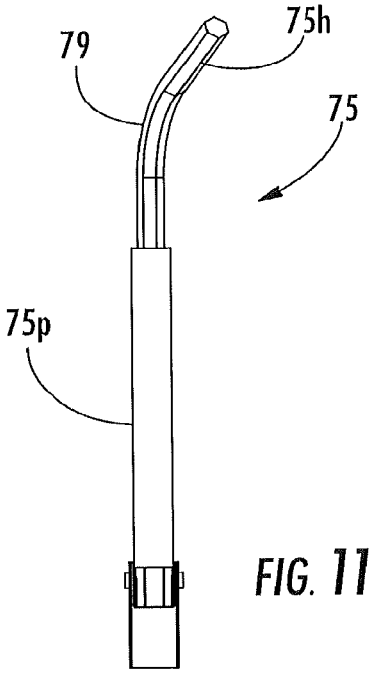
FIG. 11 is a side view (shown turned 90 degrees from the view of FIG. 10) of the exemplary stand assist support shown in FIG. 10.

The supports 75 can be an integral single piece body or may be configured as a multi-piece body. As shown in FIGS. 10-12, the support 75 includes a primary tubular member 75*p* and a telescoping hexagonal rod section 79 that slidably snugly resides in the tubular member and extends a distance upward and angles upward and laterally over toward a patient to define the handle 75*h*. However, other configurations of the supports 75 may be used.

In some embodiments, the stand-assist supports 75 are mounted to the bed frame 61 and may be able to be used as a mount system for releasably mounting the stand-assist support with handles 75*h* as well as different therapeutic or accessory devices in the same support body 75*p* when pivoted upward, e.g., slings, braces, cuffs and/or exercise accessories can releasably mount to the primary support body 75*p* after the handle 75*h* is removed (not shown). For use when the bed 10 is not in the side-egress chair bed position, the support 75 can be mounted to the outside of the frame 61 so that the mattress 18*m* or support surface 18 does not interfere with deployment of the support 75.

Figure 13A:
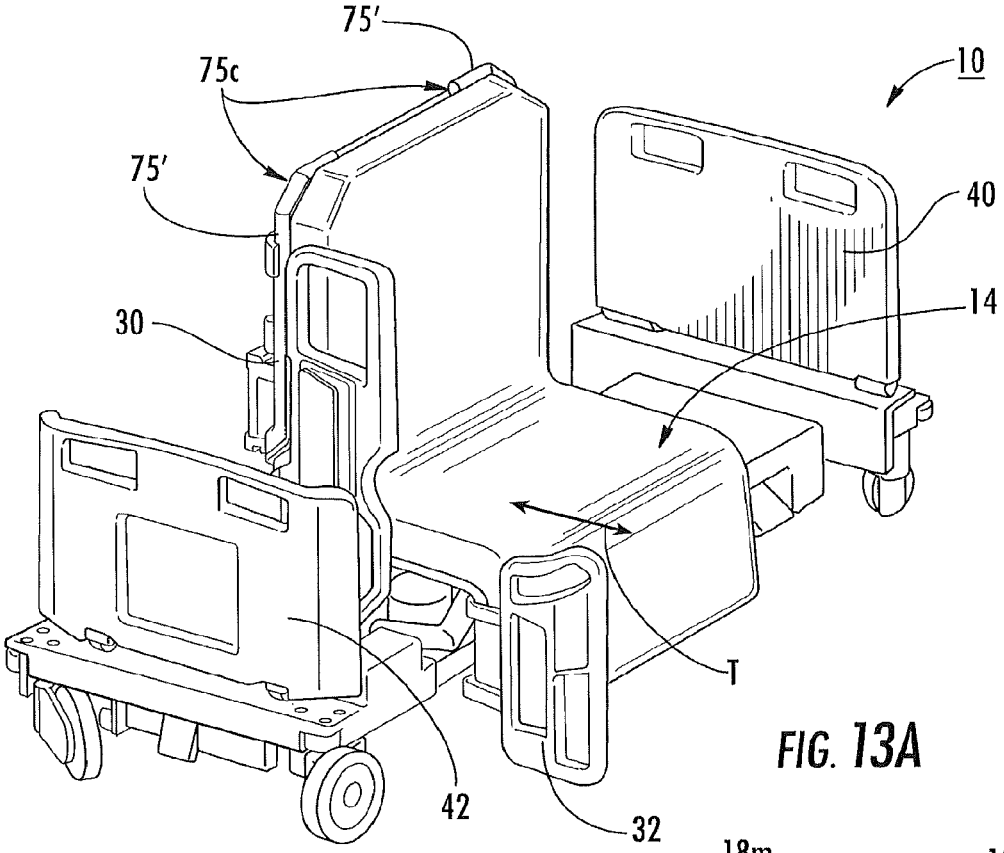
FIGS. 13A and 13B are side perspective views of an alternate embodiment showing stowable supports (rails) that can convert to exit-assist supports according to other embodiments of the present invention.
Figure 13B:
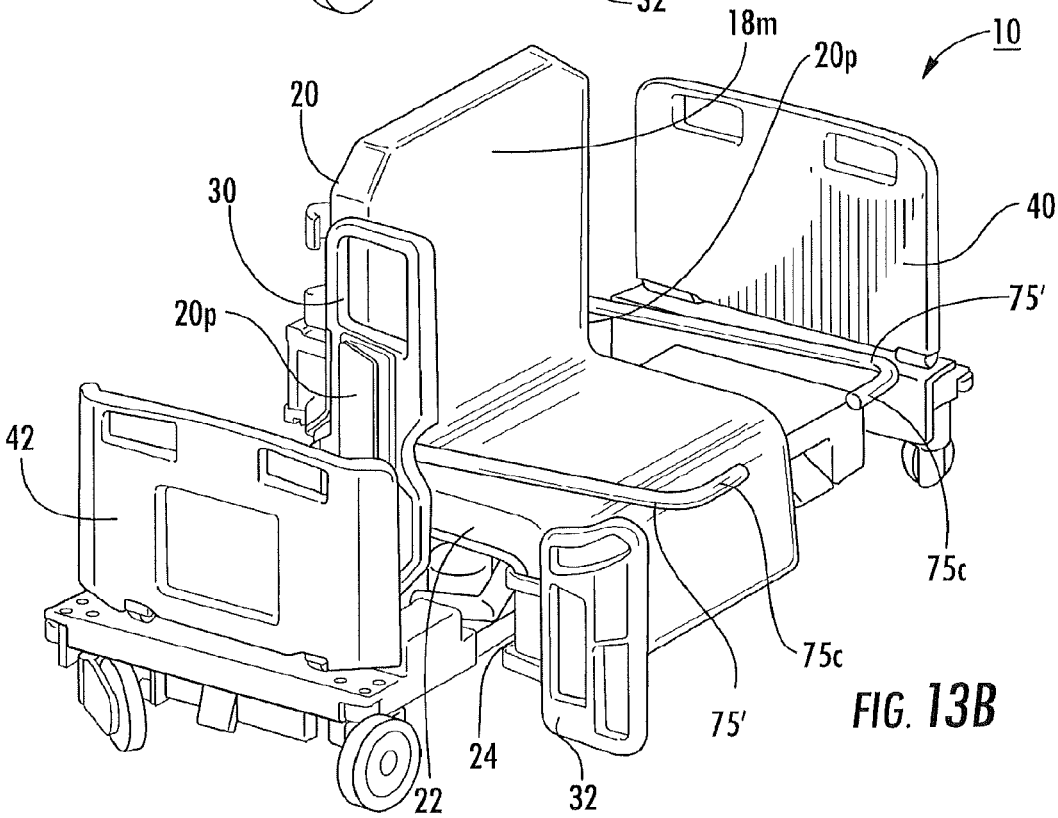

An alternative embodiment is shown in FIG. 13A and 13B. In this embodiment, the stowable supports 75' can be stowed adjacent an outer perimeter of the back panel 20. As shown in FIG. 13B, the supports 75' can be pivotally attached to a medial and/or lower portion of the back panel 20 (or upper portion of the seat panel) via pivot 20*p*. As such, the supports 75' can pivot downward to be substantially parallel to the seat section 22 of the bed 10 and reside at a distance above the mattress of the seat section 22 as shown in FIG. 13B. The supports 75' may alternatively be attached to the seat or leg panels so as to be able to rotate with the patient support surface (not shown).

Typically, the bed 10 will include two supports 75' as shown, one on each opposing side of the back panel 20. However, in other embodiments, a bed may include only one of the supports 75'.

Also, instead of the pivot attachment, which allows ease of use and requires no on site assembly, the supports 75' can be releasably stowed against the bed panel 20. In use, a nurse or other care provider can release one or both of the supports 75' and manually attach the support(s) 75' to the bed, typically at the lower portion of the back panel 20 or at an upper portion of the seat panel 22 to form the side exit rail/assist when the bed is in the chair bed configuration.

Figure 14:
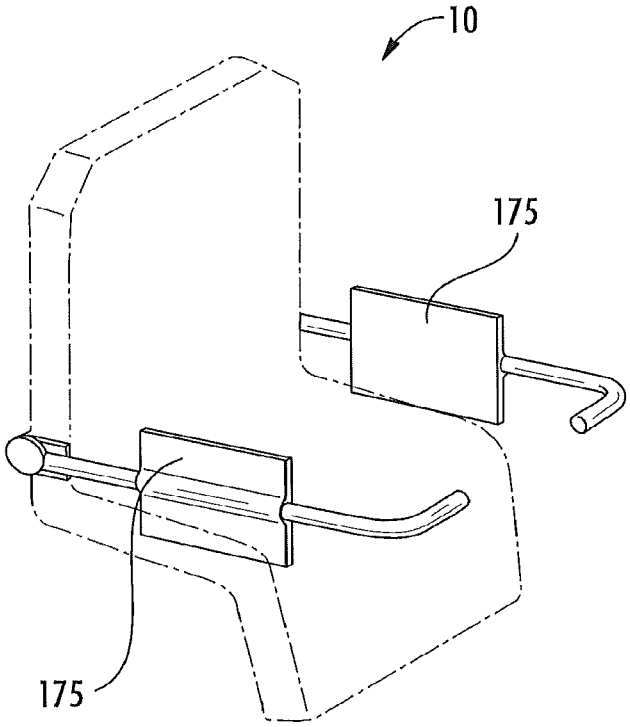
FIG. 14 is a schematic illustration of the bed shown in FIG. 13B illustrating the supports holding supplemental partitions according to some embodiments of the present invention.

The supports 75' can extend a distance above the scat panel 22 and mattress 18*m*. Typically, the supports 75' reside at a distance that is between about 3-12 inches above the mattress 18*m* of the seat panel 22. The supports 75' may also be configured to allow vertical adjustment for the deployed position to accommodate different sized/heights in patients. As shown in FIG. 14, the supports 75' may alternatively or additionally be configured to cooperate with vertically or upwardly extending partitions 175 that can provide additional barrier structure as appropriate. For example, the supports 75' can include slots on an outer surface thereof or channels extending that releasably engage upwardly and/or downwardly extending substantially planar shields that provide the partitions 175. The shields or partitions 175 may have other shapes and may have different shapes on each side of the seat section or panel 22.

The supports 75' can have a length that is less than a length of the mattress, typically a length that substantially corresponds to a length of the back panel 20. The supports 75' can define safety rails when deployed as shown in FIG. 13B. The supports 75' may provide a safety feature to inhibit a patient from falling out of the bed sideways when the bed is in the side egress chair position, for example. The supports 75' can also assist a patient in exiting the bed either in the chair or a stand assist configuration with the seat panel raised relative to the chair position. The supports 75' can be provided in telescoping configuration for length adjustment.

Figure 15:
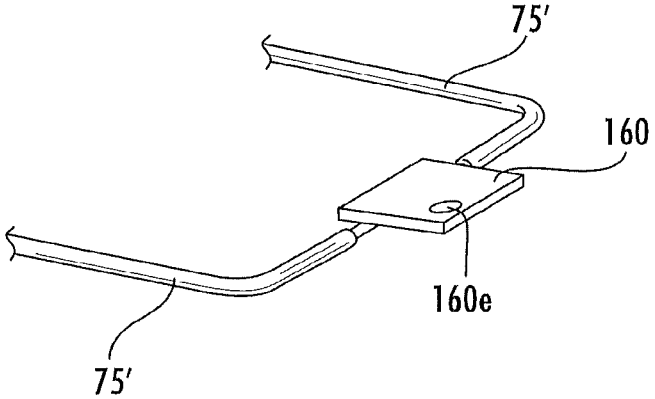
FIG. 15 is a schematic illustration of the bed shown in FIG. 13B illustrating the supports holding a table accessory item according to some embodiments of the present invention.

The supports 75' can also hold other accessory structures for ease of patient access to desired items. As shown in FIG. 15, the supports 75' can releasably hold tables 160. The tables 160 (or partitions 175, FIG. 14) can include BLUETOOTH connections, INTERNET, WIFI or other electrical connections 160*e*, including plug-in receptacles for recharging electronic devices, typically patient entertainment or communication devices such as cell phones, computers, televisions and/or MP3 players such as IPODS. The supports 75' can also hold other accessory items such as reading supports, mirrors, therapeutic devices and the like. As appropriate, struts can be used to structurally reinforce the supports. The struts can connect a seat section siderail to the corresponding support 75' (not shown).

In some embodiments, the side rails 32 proximate the leg panel 24 can translate transversely in and out (toward and away from the back panel 20) as shown by the directions of the arrows "T" in FIG. 13A. Referring to the right side of the bed in FIG. 13A and 13B, one or both of the lower side rails 24 can translate inwardly toward the center of the bed frame to expose the mattress on the leg section 24 to allow a wheel chair closer access to the patient.

As shown in FIG. 13A, the supports 75' can stow snugly against an outer perimeter of the head panel 20 proximate an outer edge portion of the mattress (and under the mattress 18*m*). The supports 75' can curve at an upper end portion 75*c* to follow the contour of the panel 20 and/or mattress 18*m*. The curve portion 75*c* can extend inwardly when deployed as shown in FIG. 13B. The curve portion 75*c* is not required but may provide additional handle support for the patient. The stand-assist supports curved end can optionally substantially correspond to a contour at an intersection of a short and long side of the bed frame and/or mattress 18*m*. The curve 75*c* may have an ergonomic three-dimensional shape for patient comfort/ease of use (such as angled and curved in three dimensions).

Although shown as rotated to the right side of the bed frame in FIG. 13A, 13B, the bed can be configured to rotate the panels 20, 22, 24 and mattress 18*m* to the left side as well to allow both right and left side egress.

The supports 75' can include other features as described above for other embodiments, for example, it is contemplated that replaceable hand grips and/or covers can be configured to slide over at least the end portions of the supports 75' (e. g. , the curved portions 75*c* where used). The outer end (shown as the curved portion 75*c*) may also or alternatively include a textured and/or elastomeric gripping surface. Replaceable (textured) end grips can be used where desired (not shown). The supports 75' can be configured to provide the structure necessary to reliably support the weight of typical patients. In some embodiments, the supports 75' can accommodate patients having a weight between about 100-500 lbs.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A hospital bed, comprising:

a base frame comprising laterally spaced apart first and second long sides and longitudinally spaced apart top and bottom end portions;

a patient support surface, wherein the patient support surface comprises a back panel, a seat panel, and a leg panel configured to articulate relative to each other, and wherein the patient support surface is configured to translate from a bed configuration to a chair configuration; and first and second spaced stand-assist supports, one residing on each side Of the back panel, wherein when the back panel is upwardly oriented and the patient support surface is in the chair configuration, the stand-assist supports reside above and on opposing sides of the seat panel, and wherein the stand-assist supports also have one of the following configurations:

(a) the stand assist supports extend outwardly from the back panel to present a free end adjacent and above the leg panel in a substantially horizontal Orientation when the patient support surface is in the chair configuration;

(b) the stand assist supports each have a single end pivotably attached to the base frame under the patient support surface to allow a respective opposing free end to pivot up and down relative to the base frame between a stowed position and an upright use position; or (c) the stand assist supports extend outwardly from the back panel toward the leg panel in a substantially horizontal orientation, each with a free outer end portion that attaches to each other to form a closed outer perimeter above and across a width Of the seat panel.

2. The bed of claim 1, further comprising a lifting mechanism secured to the base frame; and a rotating frame mounted on the lifting mechanism and supporting the patient support surface, wherein the rotating frame is configured to rotate about a vertical axis relative to the base frame;

wherein the patient support surface is configured to translate from a bed configuration to a side-egress chair configuration, and wherein the stand assist supports are attached to the back panel and are configured to rotate with the back panel to the side-egress chair configuration to have the configuration of (a) or (c).

3. The bed of claim 1, wherein the first and second stand-assist supports have a length and opposing first and second end portions, and wherein the stand assist supports have the configuration of (a) or (c) with first end portions pivotally attached to the back panel proximate a respective outer, long side portion of the back panel.

4. The bed of claim 1, wherein the stand-assist supports have a length that substantially corresponds to a length of the back panel.

5. The bed of claim 1, wherein, in a stowed configuration, the stand assist supports reside proximate the outer long sides of the back panel under the mattress and proximate an outer edge of the mattress.

6. A hospital bed, comprising:

a base frame comprising laterally spaced apart first and second long sides and longitudinally spaced apart top and bottom end portions;

a patient support surface, wherein the patient support surface comprises a back panel, a seat panel, and a leg panel configured to articulate relative to each other, and wherein the patient support surface is configured to translate from a bed configuration to a chair configuration; and first and second spaced stand-assist supports, one residing on each side of the back panel, wherein when the back panel is upwardly oriented and the patient support surface is in the chair configuration, the stand-assist supports are configured to reside above and on opposing sides of the seat panel and extend outwardly from the back panel toward the leg panel in a substantially horizontal orientation, wherein the stand-assist supports releasably engage a table.

7. A hospital bed, comprising:

a base frame comprising laterally spaced apart first and second long sides and longitudinally spaced apart top and bottom end portions;

a patient support surface, wherein the patient support surface comprises a back panel, a seat panel, and a leg panel configured to articulate relative to each other, and wherein the patient support surface is configured to translate from a bed configuration to a chair configuration; and first and second spaced stand-assist supports, one residing on each side of the back panel, wherein when the back panel is upwardly oriented and the patient support surface is in the chair configuration, the stand-assist supports are configured to reside above and on opposing sides of the seat panel and extend outwardly from the back panel toward the leg panel in a substantially horizontal orientation, wherein the stand assist supports releasably engage a partition that is sized and configured to reside above the seat panel when the bed is in a side-egress chair configuration.

8. A hospital bed, comprising:

a base frame comprising laterally spaced apart first and second long sides and longitudinally spaced apart top and bottom end portions;

a patient support surface, wherein the patient support surface comprises a back panel, a seat panel, and a leg panel configured to articulate relative to each other, and wherein the patient support surface is configured to translate from a bed configuration to a chair configuration; and first and second spaced stand-assist supports, one residing on each side of the back panel, wherein when the back panel is upwardly oriented and the patient support surface is in the chair configuration, the stand-assist supports are configured to reside above and on opposing sides of the seat panel and extend outwardly from the back panel toward the leg panel in a substantially horizontal orientation, wherein the stand-assist supports have a respective curved end with a shape that substantially corresponds to a contour at an intersection of a short and long side of the back panel of the patient support surface and/or a mattress held thereon.

9. A hospital bed, comprising:

a base frame comprising laterally spaced apart first and second long sides and longitudinally spaced apart top and bottom end portions;

a patient support surface, wherein the patient support surface comprises a back panel, a seat panel, and a leg panel configured to articulate relative to each other, and wherein the patient support surface is configured to translate from a bed configuration to a chair configuration;

first and second spaced stand-assist supports, one residing on each side of the back panel, wherein when the back panel is upwardly oriented and the patient support surface is in the chair configuration, the stand-assist supports are configured to reside above and on opposing sides of the seat panel and extend outwardly from the back panel toward the leg panel in a substantially horizontal orientation; and a pair of opposing siderails that extend on opposing sides of the leg section and reside in a substantially upright position in the chair configuration, and wherein, in the chair configuration, the siderails are configured to translate inward toward the bed frame to be flush or recessed with respect to a mattress held on the patient support surface at the leg panel.

10. A hospital bed, comprising:

a hospital bed having a patient support surface comprising a back panel, a seat panel and a leg panel, the bed configured to rotate to a side egress chair configuration, characterized in that the hospital bed comprises a pair of stand-assist supports, one residing proximate each long side of the back panel that are pivotably attached to a respective portion of the back panel and rotate with the back panel to the side-egress chair configuration, wherein, when the bed is in the side-egress chair configuration, the stand-assist supports are configured to pivot outward from the back panel to reside above and on opposing sides of the seat panel, each having a respective free outer facing end that resides apart from each other or that attach to each other at a location that is in-line with a long side of the frame above and across a width of the seat panel.

11. A method Of operating a hospital bed, comprising:

pivoting a pair of stand-assist supports from respective stowed positions proximate opposing long sides of an outer perimeter of a back panel to an outwardly extending configuration so that the supports reside above a seat panel of the patient support surface and one support resides on one side of the seat panel and the other support resides on the other side of the seat panel.

12. The method of claim 11, further comprising rotating an articulating patient support surface to a side egress position before, during or after the pivoting step.

13. A hospital bed, comprising:

a base frame comprising laterally spaced apart first and second long sides and longitudinally spaced apart top and bottom end portions;

a lifting mechanism secured to the base frame;

a rotating frame mounted on the lifting mechanism, wherein the rotating frame is configured to rotate horizontally relative to the base frame;

a patient support surface pivotally secured to the rotating frame, wherein the patient support surface comprises a back panel, a seat panel, and a leg section configured to articulate relative to each other, and wherein the patient support surface is configured to translate from a bed configuration to a side-egress chair configuration; and a pair of longitudinally spaced stand-assist supports pivotally attached to a first or second long side of the base frame, wherein when the patient support surface is in the side-egress chair configuration, the stand-assist supports are configured to extend above and on opposing sides of the seat panel and define respective supports for the patient.

14. The hospital bed of claim 13, further comprising a second pair of longitudinally spaced stand-assist supports pivotally attached to the other of the first or second long side of the base frame, wherein when the patient support surface is in the side-egress chair configuration, one pair of the stand-assist supports are configured to extend above and on opposing sides of the seat panel while the other pair are stowed in a substantially horizontal position proximate the respective long side of the base frame.

15. The hospital bed of claim 13, wherein the stand-assist supports are secured to the base frame with a releasable locking member such that they are only upwardly deployable when the patient support surface is in the side-egress position.

16. The hospital bed of claim 13 wherein the stand-assist supports block rotation of the patient support surface while extended.

17. The hospital bed of claim 13, wherein the stand-assist supports comprise an angular upper portion that extend to provide respective handles with gripping surfaces for a patient.

18. The hospital bed of claim 17, wherein each handle is shaped the same, and wherein each handle has an angle of between about 100-130 degrees measured from a line drawn through a tip of the respective handle to an intersecting line drawn perpendicular to a centerline of the second portion.

19. The hospital bed of claim 13, wherein at least one of the stand-assist supports is releasably mounted to the base frame and, when released, defines a cane that can be used by a patient.

20. The hospital bed of claim 13, wherein the stand-assist supports are mounted to the base frame to allow the supports to be longitudinally moved about the base frame to allow for inward and outward lateral adjustment with respect to the seat section in the side-egress chair position.

21. The hospital bed of claim 13, wherein the stand-assist supports are mounted to the base frame to be able to be adjusted in height to lock in different height positions.

22. The hospital bed of claim 13, further comprising a first pair of side rails and a second pair of side rails longitudinally spaced apart from the first pair of side rails, wherein each side rail is movably mounted to the bed with the first pair residing on opposing sides of the back panel and the second pair residing on opposing sides of the leg section, with the second pair configured to reside substantially vertically when the bed is in the side-egress chair configuration, and wherein, when the bed is in the side-egress chair configuration, the stand-assist supports have handles that extend toward each other across the seat panel above the second pair of side rails and closer to a center of the seat section than the second pair of side rails.

23. The hospital bed of claim 13, wherein the leg section comprises first, second, and third panels pivotally connected together in series, wherein the leg section first panel is pivotally connected to the seat panel, and wherein at least some of the plurality of leg section panels are configured to overlap each other when the patient support surface is in the side egress chair configuration so that at least two of the leg section panels are in a substantially horizontal orientation.

24. The hospital bed of claim 23, wherein the hospital bed is configured to translate to a stand-assist configuration whereby the seat panel is tilted downward while the back panel is substantially upright.

25. A method of operating a hospital bed, comprising:

rotating an articulating patient support surface from a bed position to a side egress position; then after the rotating step, manually or automatically extending a pair of stand-assist supports from a stowed position to an upwardly extending configuration so that one support resides on one side of a seat section and the other resides on the other side of the seat section; and inhibiting rotation of the patient support surface back to a bed position while the stand-assist supports are extended, wherein the extending is carried out by one of the following:

(a) pivoting one end of each of the stand assist supports from a stow position against a back panel of the patient support surface so that a free end of each extends forward in a horizontal orientation above the seat surface; or (b) pivoting one end of each of the stand assist supports from a stow position against the base under the patient support surface to an upright position to define a free end portion of the stand assist support residing above the seat section.

26. A method of operating a hospital bed, comprising:

rotating an articulating patient support surface from a bed position to a side egress position; then after the rotating step, manually or automatically extending a pair of stand-assist supports from a stowed position to an upwardly extending configuration so that one support resides on one side of a seat section and the other resides on the Other side of the seat section;

inhibiting rotation of the patient support surface back to a bed position while the stand-assist supports are extended; and tilting the seat section downward while the back section is substantially upright to move the bed to a stand-assist side egress configuration while the stand-assist supports are extended.

27. A method of operating a hospital bed, comprising:

rotating an articulating patient support surface from a bed position to a side egress position; then after the rotating step, manually or automatically extending a pair Of stand-assist supports from a stowed position to an upwardly extending configuration so that one support resides on one side of a seat section and the other resides on the other side of the seat section;

inhibiting rotation of the patient support surface back to a bed position while the stand-assist supports are extended., and rotating patient side rails with the back seat and leg sections then tilting the patient side rails down toward a floor before or during the extending step, wherein the extending step is carried out so that the pair of stand-assist supports reside above the side rails and so that a handle portion of each faces each other and resides over the seat section.

28. A method according to claim 25, further comprising allowing a user to remove at least one of the stand-assist supports from the bed for use as a cane.

29. A method according to claim 25, further comprising:

translating the leg section panels so that at least two of the leg section panels are in a substantially horizontal orientation during or after the rotating step, before the tilting step.

* * * * *